United States Patent [19]

Arute et al.

[11] Patent Number: 4,593,945

[45] Date of Patent: Jun. 10, 1986

[54] OVEN LATCH ASSEMBLY

[75] Inventors: William J. Arute, Plainville; Thomas W. Spargo, Terryville; Edward C. Ambler, Newington, all of Conn.

[73] Assignee: The Stanley Works, New Britian, Conn.

[21] Appl. No.: 589,596

[22] Filed: Mar. 14, 1984

[51] Int. Cl.[4] ..... E05C 3/06

[52] U.S. Cl. ..... 292/201; 292/113; 292/DIG. 69

[58] Field of Search ..... 126/197; 292/201, 198, 292/216, 227, 110, 111, 113, 127, DIG. 65, DIG. 69

[56] References Cited

U.S. PATENT DOCUMENTS

| | | | |
|---|---|---|---|
| Re. 27,276 | 1/1972 | Erickson . | |
| Re. 27,291 | 2/1972 | Fowler . | |
| 1,629,641 | 5/1927 | Schlafly . | |
| 2,097,232 | 10/1937 | Hartman . | |
| 2,637,576 | 5/1953 | Nottingham | 292/198 X |
| 2,679,427 | 5/1954 | Johnson . | |
| 2,714,751 | 8/1955 | Stuart et al. . | |
| 2,789,852 | 4/1957 | Eads . | |
| 2,926,945 | 3/1960 | Clark . | |
| 2,954,252 | 9/1960 | Carpenter . | |
| 3,189,375 | 6/1965 | Getman . | |
| 3,321,226 | 5/1967 | De Claire et al. . | |
| 3,328,062 | 6/1967 | Geiger et al. . | |
| 3,362,398 | 1/1968 | Fane, Jr. . | |
| 3,367,697 | 2/1968 | Fox, Sr. . | |
| 3,406,677 | 10/1968 | Anderson . | |
| 3,438,666 | 4/1969 | Erickson . | |
| 3,450,767 | 6/1969 | Siegel . | |
| 3,469,568 | 9/1969 | Torrey et al. . | |
| 3,476,424 | 11/1969 | Erickson . | |
| 3,646,612 | 2/1972 | Anderson . | |
| 3,661,410 | 5/1972 | Larson et al. . | |
| 3,745,988 | 7/1973 | Frick . | |
| 3,750,643 | 8/1973 | Fowler et al. . | |
| 3,757,084 | 9/1973 | McLean et al. . | |
| 3,806,174 | 4/1974 | Herman . | |
| 3,831,580 | 8/1974 | McLean . | |
| 3,888,528 | 6/1975 | Jericijo . | |
| 4,095,827 | 6/1978 | Stavenan . | |
| 4,163,443 | 8/1979 | Peterson . | |
| 4,174,860 | 11/1979 | Shea | 292/113 |
| 4,351,288 | 9/1982 | Gasloli | 292/113 X |
| 4,364,589 | 12/1982 | Watson | 292/113 |

FOREIGN PATENT DOCUMENTS

| | | | |
|---|---|---|---|
| 2826712 | 12/1979 | Fed. Rep. of Germany | 292/DIG. 69 |
| 274497 | 12/1927 | United Kingdom . | |

*Primary Examiner*—Robert L. Wolfe
*Assistant Examiner*—Russell W. Illich

[57] ABSTRACT

An automatic safety latch assembly for use in combination with a striker on a door of a self-cleaning kitchen range has a bolt which is mounted for rotational movement and subsequent longitudinal movement to a latched position. An over-center biasing arrangement is provided to bias the latching mechanism into both the latched and unlatched positions of the latch bolt. A door sensing element is cooperatively engaged with the latch bolt to prevent accidental tripping of the latching mechanism until the oven door is properly positioned. The latching mechanism includes a thermally responsive blocking mechanism to lock the latch bolt in the latched position and prevent the opening of the oven door during the high temeprature self-cleaning cycle of the kitchen range.

25 Claims, 14 Drawing Figures

OVEN LATCH ASSEMBLY

BACKGROUND OF THE INVENTION

The present invention relates to latching mechanisms for oven doors and, more particularly, to oven door latching mechanisms usable in combination with a self-cleaning oven of a kitchen range.

Initially, ovens for domestic use were provided with pivotally mounted doors having a heavy duty spring thereon for biasing the door into the closed position. However, with the advent of self-cleaning ovens utilizing high temperature cleaning cycles, it became necessary to develop latching mechanisms for holding the door in a sealed relationship with respect to the oven cavity. A number of types of oven door latching mechanisms for self-cleaning ovens have been developed over the years. One type of oven door latching mechanism is exemplified by Fox U.S. Pat. No. 3,367,697. The user of the appliance must manually move an actuating handle to engages and latches the door in the closed position before initiating the self-cleaning cycle of the oven.

Another type of latching mechanism for an oven door is exemplified by McLean U.S. Pat. No. 3,831,580 and Peterson U.S. Pat. No. 4,163,443. These mechanisms have eliminated the need for a handle to latch the oven door and use a latch bolt moving longitudinally and simultaneously rotating upon engagement with a latch pin. Subsequent to the latching operation, the latch is locked in its retracted position by a thermally responsive interlock for preventing the latch from operating during the self-cleaning cycle of the oven. However, the latch bolt extends from the oven body and is in a position which would allow it to be accidentally tripped by the user when the oven door is not in position to be closed.

It is an object of the present invention to provide a novel and effective oven door latch mechanism for use in combination with a self-cleaning oven of a kitchen range.

It is also an object to provide such a latch mechanism with novel means for locking the latch in the closed or latched position during high temperature operation of the oven.

Another object is to provide such a latch mechanism which has a door sensing element to prevent accidental latching or tripping of the latching mechanism.

It is a further object to provide such a latch mechanism which is relatively inexpensive to fabricate and durable in operation.

SUMMARY OF THE INVENTION

It has been found that the foregoing and related objects may be readily attained in an automatic safety latch for use in combination with an oven door in a self-cleaning kitchen range having a striker on the door to be engaged therewith. The latch including a base plate, a latch bolt projecting beyond the base plate and having a slot extending inwardly from one side margin of the projecting portion adapted to receive and engage the associated striker and means mounting the latch bolt on the base plate for initial rotational movement from an unlatched position to an intermediate position in which the associated striker is aligned in the slot and for subsequent generally rectilinear movement to a latched position to fully seat the associated striker within the slot. Biasing means biases the latch bolt into each of the unlatched, intermediate and latched positions and permits the rotational and rectilinear movement of the latch bolt while door sensing means is operable upon closing of the associated door to permit movement of the latch bolt into the latched position. Lock means is movable on the base plate from a first position to a second position operatively engageable with the biasing means in the latched position of the latch bolt to prevent movement of the biasing means and thereby the latch bolt from the latched position to the unlatched position and has actuating means associated therewith for moving the lock means to the second position and operable upon movement of the associated oven door to the fully closed position.

Desirably, the biasing means includes a latch member, first pivot means pivotably mounting the latch member to the base plate for movement from a first position to a second position, second pivot means pivotably connecting the latch member and the latch bolt at a point spaced from the first pivot means and spring means biasing the latch member and thereby the latch bolt into each of the unlatched, intermediate and latched positions thereof. The lock means is operatively engageable with the latch member to prevent its movement from its second position to the first position and thereby to lock the latch bolt in its latched position.

Conveniently, the mounting means includes cam means operative between the latch member and the latch bolt, the cam means and the first pivot means include a common pivot pin fixed in one of the latch bolt and latch member and a cam slot in the other of the members. The mounting means for the latch bolt includes a generally V-shaped slot in one of the latch bolt and the base plate adjacent the projecting portion and a cam follower pin in the other thereof slidably seated in the v-shaped slot, a pivot mounting between the bolt and the latch member adjacent the side margin of the bolt on which the striker receiving slot opens and adjacent the end of the bolt spaced from the projecting portion, and an arcuate cam slot in the latch bolt adjacent the end opposite the projecting portion and spaced from the pivot mounting, and wherein the pivot pin for the latch member also comprises a cam follower pin slidably seated in the arcuate cam slot.

In the preferred embodiment, the actuating means includes manually operable switch means to energize the actuating means and effect movement of the locking means from the first position to the second position. The actuating means includes solenoid means operatively engageable with the lock member upon energization by the switch means to permit its movement from the first position to the second position. The locking means includes a lever member pivotably mounted at one end to the base plate, spring means normally biasing the lever member into a first position, and a lock member movably supported on the lever member and engageable with the biasing means upon movement thereof from a first position to a second position to prevent movement of the biasing means and thereby movement of the latch bolt whereby the solenoid means is operable on the lever to overcome the spring means to permit movement of the lever member and thereby the lock member. The lock member is pivotably mounted on the lever at a point spaced from the lever pivot and wherein the locking means additionally includes spring means biasing the lock member to its locking position.

In a second embodiment, the actuating means includes heat-responsive means operable upon reaching a predetermined temperature to move the locking means from the first position to the second position and thereafter upon dropping below a predetermined temperature to move the locking means from the second position to the first position and thereby to enable movement of the latch bolt to the unlatched position. The locking means is mounted upon one end of a rotatable shaft and the heat-responsive means includes a bimetallic coil connected to the shaft to effect its rotation in response to temperature changes.

Ideally, the door sensor means includes a sensor member movably supported on the base plate for movement between a first position and a second position upon closing of the associated door and operatively engaged with the latch bolt to prevent its movement to the latched position until the sensor member is moved to the second position. The sensor member is elongated and mounted for generally rectilinear movement relative to the base plate and wherein an actuator member is pivotally connected at one end thereto and at its other end to the bolt member whereby generally rectilinear movement of the sensor member will permit subsequent generally rectilinear movement of the latch bolt. The base plate includes a cam slot underlying the pivotal connection between the sensor member and the actuator member and wherein the pivotal connection between the sensor and actuator members comprises a cam follower pin slidably seated in the cam slot of the base plate. The sensor member operatively acts upon the latch member upon movement into its second position to permit movement of the members of the latch and thereby the bolt into its latched position.

DETAILED DESCRIPTION OF THE ILLUSTRATED EMBODIMENTS

Figure 1:
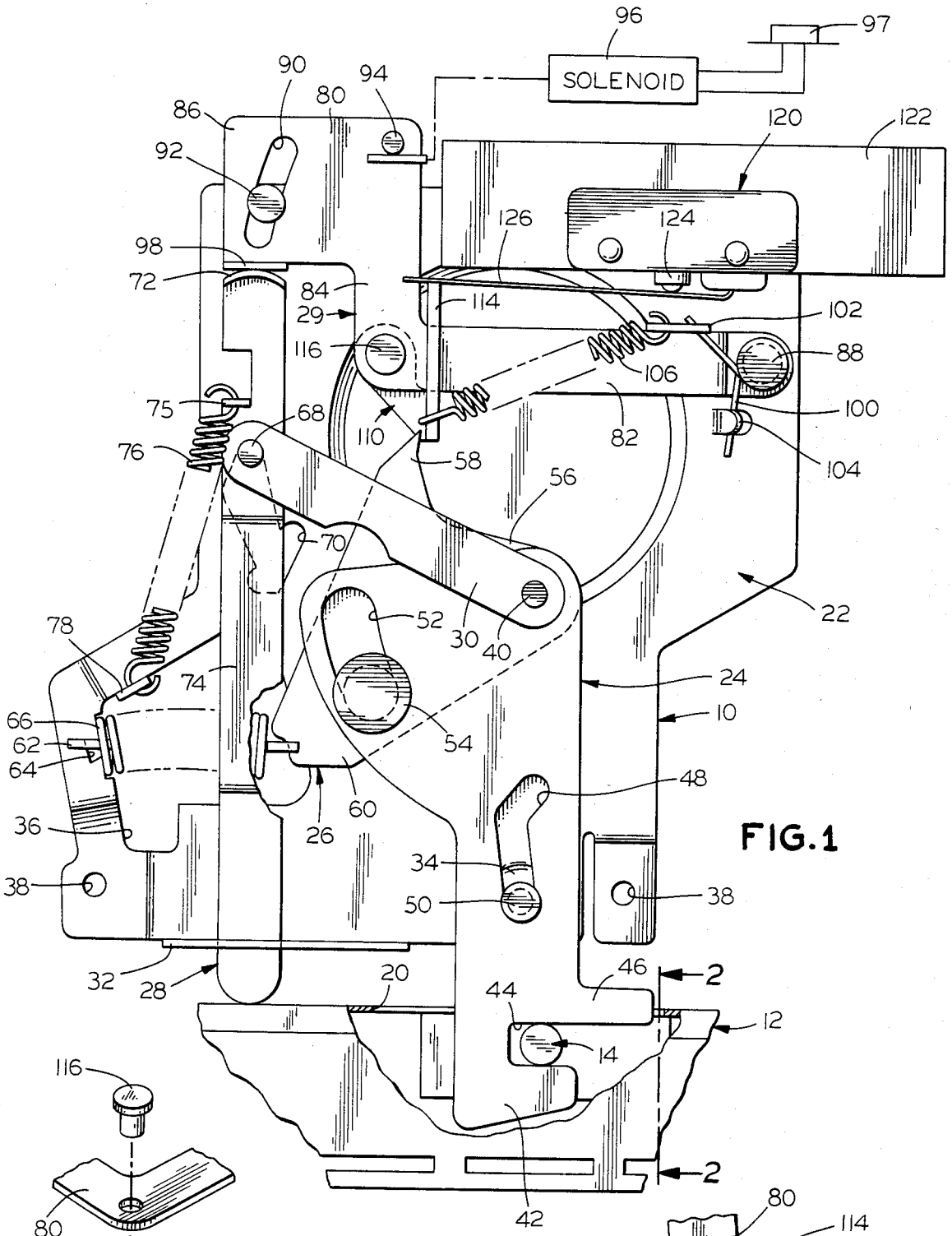
FIG. 1 is a plan view of an oven door latch embodying the present invention in the latched and locked position with the striker of a fragmentarily illustrated portion of an oven door, and diagrammatically showing the solenoid and clean able switch.
Figure 2:
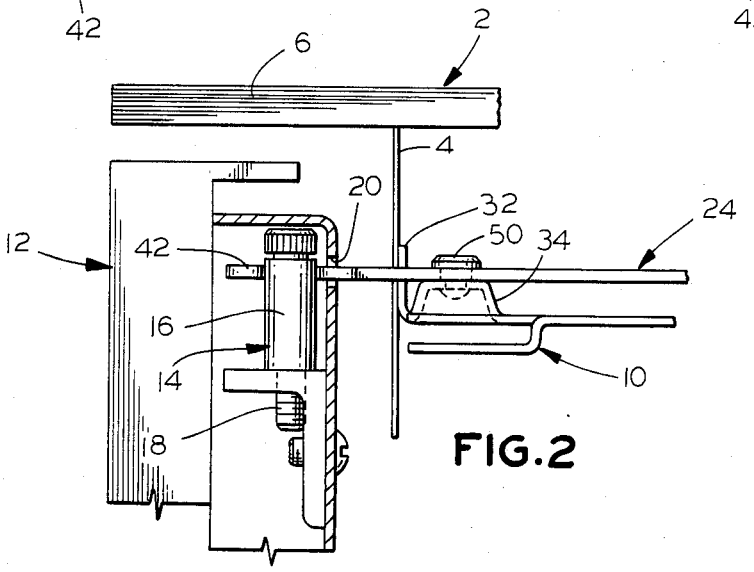
FIG. 2 is a fragmentary sectional view generally along the line 2—2 of FIG. 1 with the door fragmentarily illustrated and only portions of the latch mechanism shown to illustrate the manner of engagement with the striker of the oven door.

Turning first in detail to the embodiment of FIGS. 1–10, therein fragmentarily illustrated is an oven door generally designated by the numeral 12 which is adapted to pivot about its lower end on the oven housing generally designated by the numeral 2 and having a cavity therewithin in which is disposed a striker or door latch pin generally designated by the numeral 14. In its interior face, the oven door 12 has a slot 20 registering with the striker 14. As best seen in FIG. 2, the striker 14 includes a roller 16 supported on a threaded member 18 within the cavity of the door 12.

As is also best seen in FIG. 2, the oven housing or frame 2 has an overhanging portion designated by the numeral 6 which overlies the oven door 12 in its closed position, and a front wall 4. Secured in the oven housing 2 against the front wall 4 is the latch assembly of the present invention generally designated by the numeral 10.

Turning again to FIG. 1, the latch assembly 10 can be seen as generally including a base plate generally designated by the numeral 22, the latch bolt generally designated by the numeral 24 an actuator arm 30, a latch member generally designated by the numeral 26, a solenoid locking assembly generally designated by the numeral 29 and a door sensor bar generally designated by the numeral 28. Various other elements of the assembly will be described during the more detailed explanation hereinafter.

Turning now in detail to the base plate 22, it is formed with a series of cutouts and upwardly and downwardly bent portions which provide the means for mounting the latch assembly 10 and the clearance for movement of its parts and support for others of its parts. Included are an upstanding front wall 32 which is disposed against the front wall 4 of the oven housing 2 and a pedestal portion 34, both seen in FIGS. 1 and 2. Apertures 38 are provided in marginal portions thereof as seen in FIG. 1 for securing the base plate 22 to the oven frame 2 by fasteners (not shown).

The latch bolt 24 is pivotably and movably mounted on the base plate 22 and has an outer or nose portion 22 in which is formed the latch slot 44 opening on its side margin towards the striker 14 and an abutment finger 46 which projects laterally from the nose portion 42 to effect a continuation of the inner wall of the slot 44. Spaced inwardly from the nose portion 42 is a generally V-shaped cam slot 48 in which is slidably received the headed cam pin 50 secured in the pedestal portion 34 of the base plate 22. Adjacent the inner end of the latch bolt 24 and to the side opposite from the latch slot 44 is an arcuate cam slot 52 in which is slidably seated the cam pin 54 which is secured to the base plate 22 and which provides the pivotal mounting for the latch member 26 disposed between the latch bolt 24 and the base plate 22.

Figure 5:
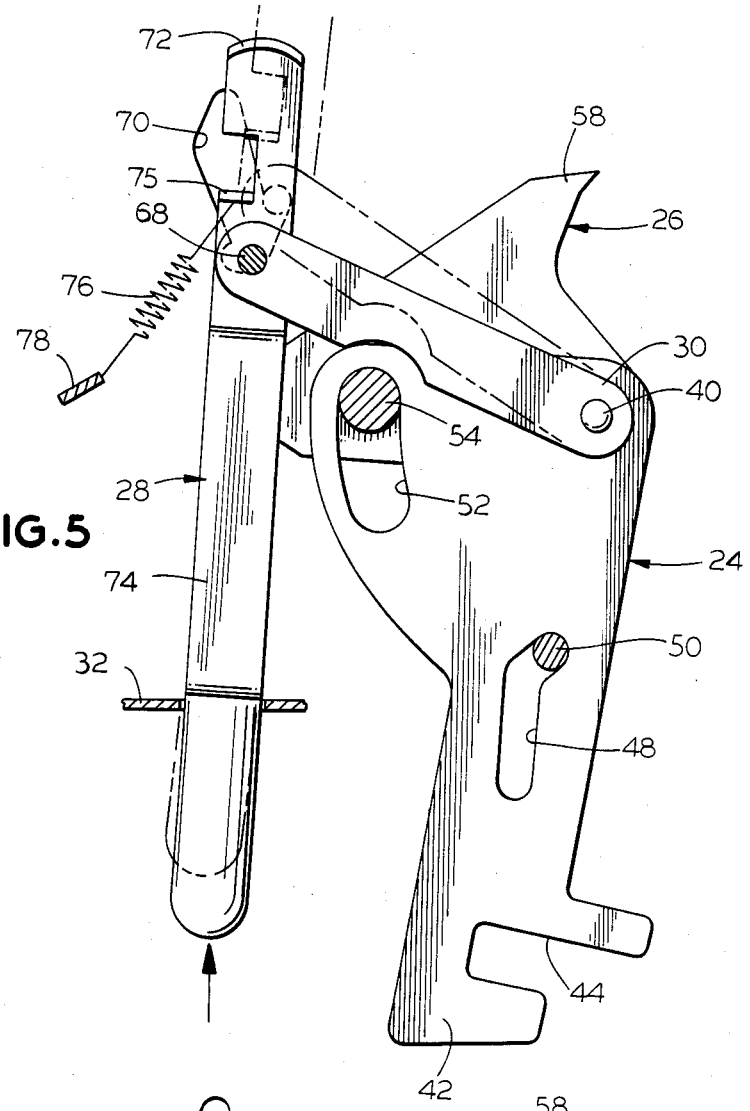
FIG. 5 is a diagrammatic view showing the manner in which the door sensor bar and actuator arm move from the position shown in solid line to the position shown in phantom line if the door sensor bar is manipulated without simultaneous manipulation of the latch bolt.
Figure 6:
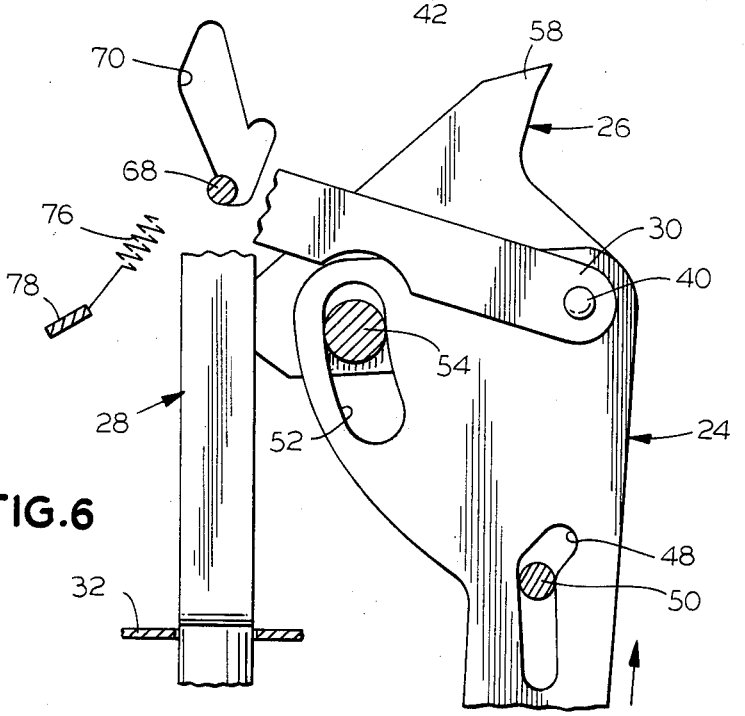
FIG. 6 is a view similar to FIG. 5 showing the limitation of the latch bolt movement if the door sensor bar is not moved inwardly of the oven.

As best seen in FIGS. 5 and 6, the latch member 26 is pivotably secured to the latch bolt 24 and to the actuator arm 30 by the pivot pin 40 at a point spaced from the cam pin 54. The latch member 26 is of generally triangular configuration with a generally V-shaped recess in its widest portion. The forwardmost leg portion defining the V-shaped recess bears the numeral 56 and has the bolt pivot pin 40 extending therethrough. The opposite leg portion defining the V-shaped recess bears the reference numeral 58 and the base portion of the latch member 26 bears the reference numeral 60 and has the cam pin 54 seated therein.

Also pivotably supported on the pivot pin 40 is one end of the actuator arm 30, and, at its other end, it has a cam follower pin 68 which seats in a cam slot 70 formed in the base plate 22.

Pivotably engaged with the actuator arm 30 by the cam follower pin 68 is the elongated sensor bar 28 which has its outer end extending outwardly through a slot in the front wall portion 32 of the base plate 22 so that it will abut the inside face of the oven door 12 as it is closed. The intermediate portion of the door sensor bar 28 is formed with an upstanding bridge portion 74 so as to permit movement of the base portion 60 of the latch member 26 thereunder. At its inner end, the door sensor bar 28 is provided with an upstanding abutment shoulder 72. Extending between the upstanding ear 75 on the sensor bar 28 and the upstanding ear 78 on the base plate 22 is an elongated tension spring 76 to bias the door sensor bar 28 outwardly of the oven housing 2 so as to contact the oven door 12 during its closing movement.

The base plate 22 is provided with an irregularly shaped cutout 36 below the sensor bar 28 and located towards the outer end thereof. The base portion 60 of the latch member 26 has an arcuate recess therein in which is slidably seated the notched head of a generally T-shaped compression spring holder designated by the numeral 62. The opposite side of the cutout 36 is provided with a notch 64 in which is disposed the slotted stem of the T-shaped spring holder 62. Disposed about the stem of the spring holder 62 is a compression spring 66 which bears against the wall of the base plate 22 defining the cutout 36 and at its other end bearing against the head of the spring holder 62 and thereby applying biasing pressure against the latch member 26 and biasing it in both the latched and unlatched positions as latch member 26 is pivoted around about cam pin 54 in an over center biasing arrangement.

The solenoid locking assembly 29 includes a solenoid lever 80 which is of generally Z-shaped configuration with a relatively thin forward leg 82 and intermediate leg 84 and a relatively enlarged rearward leg 86. The outer end of the leg 82 is pivotably mounted upon the base plate 22 by the pivot pin 88, and an arcuate slot 90 is provided in the enlarged rearward leg portion 86 adjacent its edge portion most remote from the pivot pin 88, in which is slidably disposed cam pin 92 seated in the base plate 22. Adjacent its opposite edge and the rearward end thereof, the rearward leg portion 86 is provided with an upstanding pin 94 which is acted upon by the solenoid shown schematically in FIGS. 7 and 8 and designated by the numeral 96. A manually actuated oven cleaning control switch 97 actuates the solenoid 96 to pivot the solenoid lever 80 between the positions shown in FIGS. 7 and 8. The forward edge of the rearward leg portion 86 is also provided with an upstanding ear 98 against which the abutment shoulder 72 on the door sensor bar 28 will bear.

Figure 9:
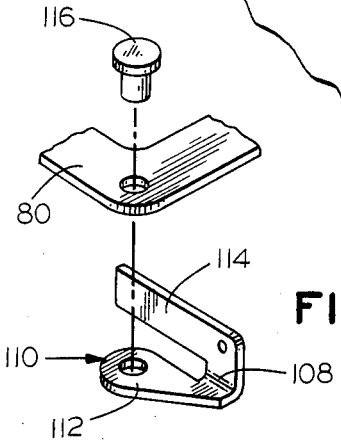
FIG. 9 is a fragmentary exploded perspective view of portions of the solenoid lever and lock member of FIGS. 7 and 8.
Figure 10:
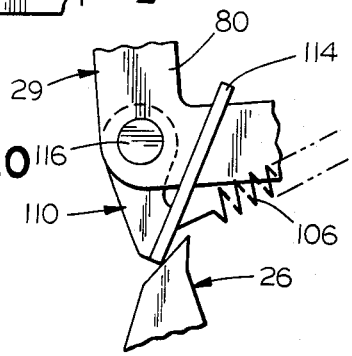
FIG. 10 is a fragmentary plan view of the lock member and solenoid mechanism of FIG. 1 with the lock member and latch member held by the solenoid in the unlocked position of the latch mechanism.

A coil spring 100 is disposed about the pivot pin 88 above the solenoid lever 80 and has one projecting end portion seated in the upstanding ear 102 formed in along the rearward edge of the forward leg portion 82 of the lever 80 and the other extending end portion abutting against an upstanding finger 104 formed in the base plate 22 forwardly of the solenoid lever 80. This spring 100 will normally bias the solenoid lever 80 about the pivot pin 88 in a counterclockwise direction to the position seen in FIG. 7. Also seated in the upstanding ear 102 of the solenoid lever 80 is one end of a coiled tension spring 106 which extends forwardly and away from the pivot pin 88. Its opposite end is engaged in the web portion 108 of the flipper member generally designated by the numeral 110. As best seen in FIG. 9, the flipper member 110 has a generally planar base portion 112, the web portion 108 at the forward end thereof and a top arm portion 114 extending from the web portion 108 generally in spaced relationship to the base portion 112 and above the forward leg portion 82 of the solenoid lever 80 adjacent its juncture with the intermediate leg portion 84. The pivot pin 116 provides a pivotal connection between the intermediate leg portion 84 of the solenoid lever 80 and the base portion 112 of the flipper member 110 at a point spaced from the web portion 108. As a result, the spring 106 will normally bias the flipper member 110 in a counterclockwise direction into the position seen in FIG. 7.

Carried on the support bar 122 is a clean enabling switch generally designated by the numeral 120 and having a contact button 124 which must be pressed to close the switch 120 to enable current flow therethrough. The clean enabling switch 120 is connected to the electronic control circuitry (not shown) of the kitchen range. Also mounted on the switch 120 is a elongated flexible actuator arm 126 which extends therefrom to a point beyond the upper portion 114 of the flipper member 110 so as to be biased thereby against the contact button 124 when the solenoid lever 80 is moved into the position seen in FIG. 1.

Figure 3:
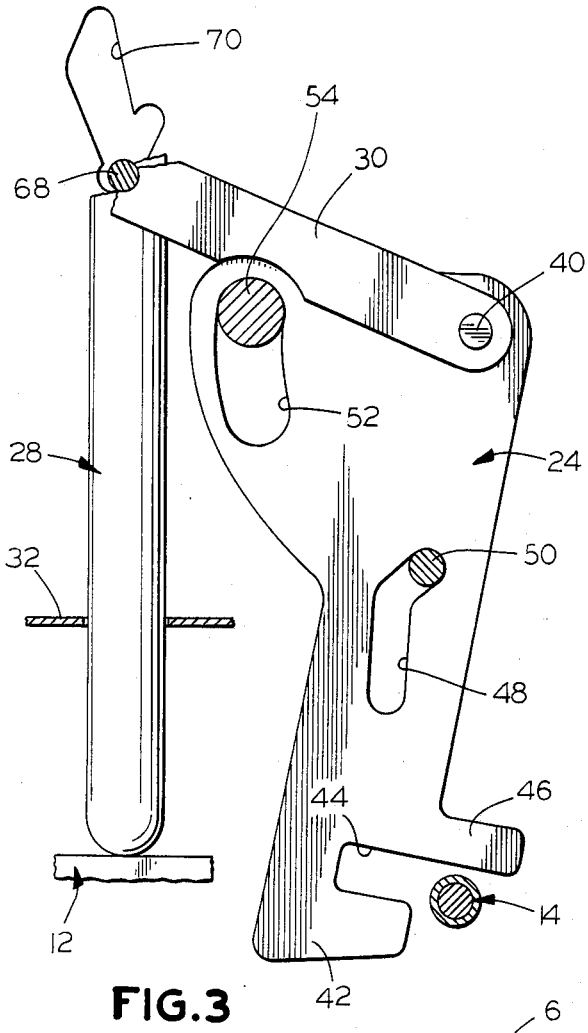
FIG. 3 is a partially diagrammatic fragmentary plan view of the latch bolt and door sensor elements of the oven latch mechanism in the unlatched position as the oven door (fragmentarily illustrated) initially moves into contact therewith.
Figure 4:
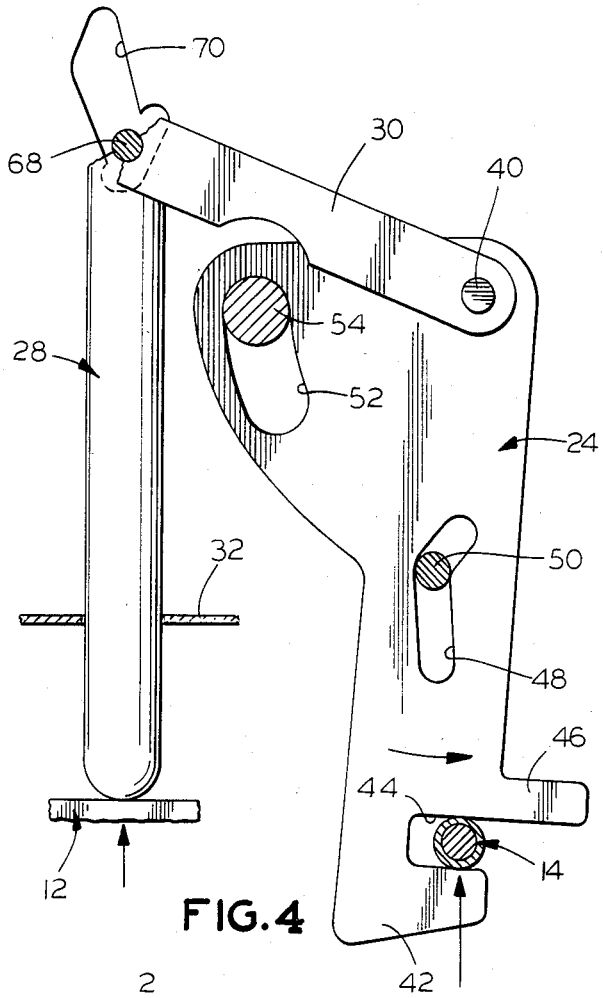
FIG. 4 is a view similar to FIG. 3 with the elements of the mechanism moved into the intermediate position as the oven door is being further closed.

In operation, the user can close the door 12 by simply pivoting it into engagement with the latch assembly 10 as shown in FIG. 3. The door 12 initially abuts and moves the door sensor bar 28 in a generally rectilinear direction from the position shown in FIG. 3 to the position shown in FIG. 4. Meanwhile, the striker or latch pin 14 engages the latch bolt 24 and rotates it against the bias of the over center biasing arrangement and around cam pin 54 into the intermediate position shown in FIG. 4. Thus, the door sensor bar 28 and the cam follower pin 68 are in the proper position relative to the cam slot 70 to allow the latch bolt 24 to move generally rectilinearly along cam pins 50 and 54 into the latched position shown in FIG. 1. The door sensor bar 28 continues to move laterally and rearwardly in the cam slot 70 as the door 12 moves the latch bolt 24 from the intermediate position into its latched position.

Figure 7:
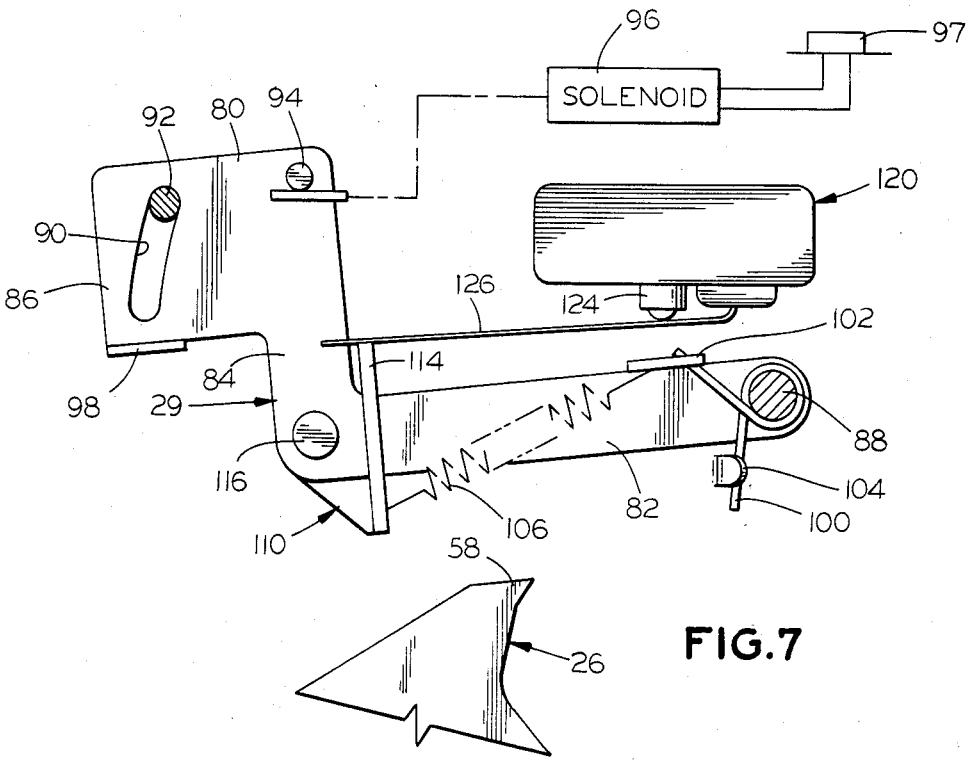
FIG. 7 is a diagrammatic view showing the latch member fragmentarily illustrated and the solenoid mechanism with the several elements in the unlatched and unlocked position of the latch bolt.

During the latching procedure, the solenoid lever 80 is normally biased into the position shown in FIG. 7 by the spring 100. The latch member 26 rotates the flipper member 110 around pivot 116 (FIG. 10), and the abutment shoulder 72 of the door sensor bar 28 abuts the ear 98 to pivot the solenoid lever 80 around the pivot pin 88 against the bias of the spring 100.

After the door 12 and the latch assembly 10 are in their latched position, the user may wish to engage the self cleaning cycle of the oven. The user simply pushes the oven cleaning control switch 97, thereby activating the solenoid 96 to move the solenoid lever 80 upwardly from the position shown in FIG. 10 to the position shown in FIG. 8. Meanwhile, the flipper tension spring 106 biases the flipper member 110 into the position shown in FIG. 8. When the user releases the oven cleaning control switch 97, the solenoid 96 deactivates and the bias of the spring 100 returns the lever into an abutting position with the door sensor bar 28 to lock the latch assembly 10 in the latched position as shown in FIG. 1.

As seen in FIG. 1, the upper portion 114 of the flipper 116 engages the switch actuator arm 126 to bias the clean enabling switch 120 into the closed or active position to allow the high temperature cleaning cycle to begin only when abutment shoulder 72 of the door sensor bar 28 abuts the ear 98 of the lever 80. Thus, the flipper member 110, the door sensor bar 28 and, therefore, the oven door 12 must be positioned as illustrated in FIG. 1 to activate the high temperature self-cleaning cycle.

Figure 8:
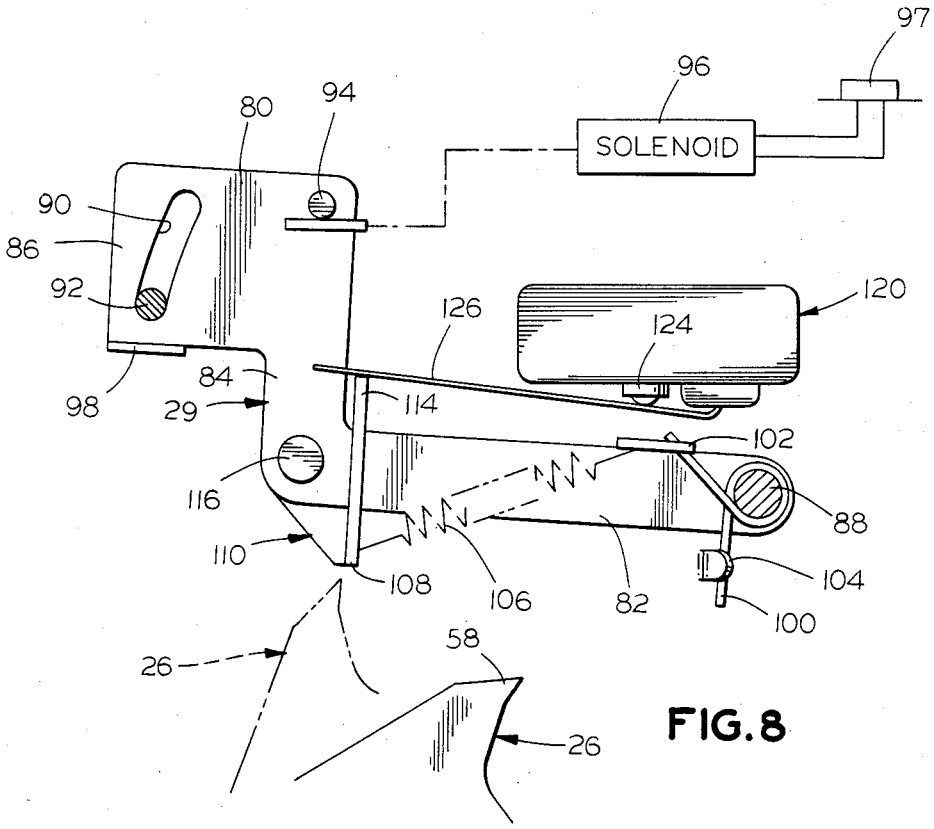
FIG. 8 is a similar view wherein the solenoid has been actuated to raise the solenoid lever and the latch member is shown in the full line unlatched position and the phantom line latched position wherein it may be locked upon return of the solenoid mechanism to the position shown in FIG. 7.
Figure 11:
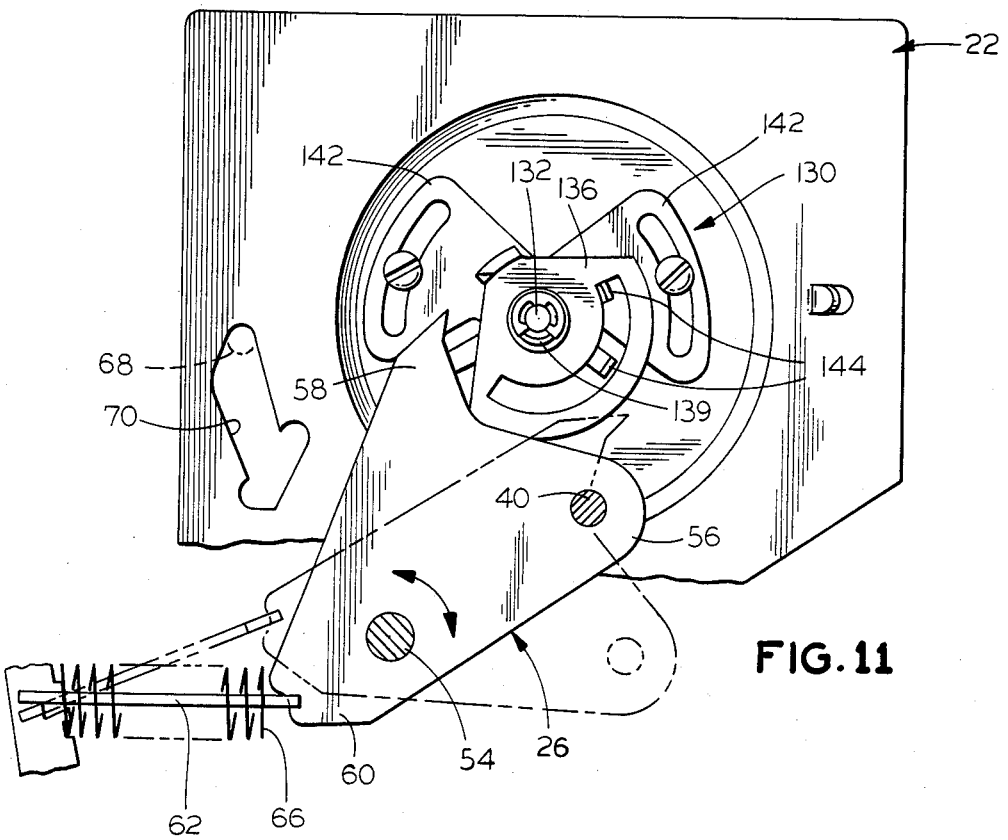
FIG. 11 is a fragmentary and partially diagrammatic view of a latch assembly employing a bimetallic mechanism to engage the latch member and thereby lock the latch mechanism, with the latch member shown in full line in the latched position and in phantom line in its unlatched position.
Figure 12:
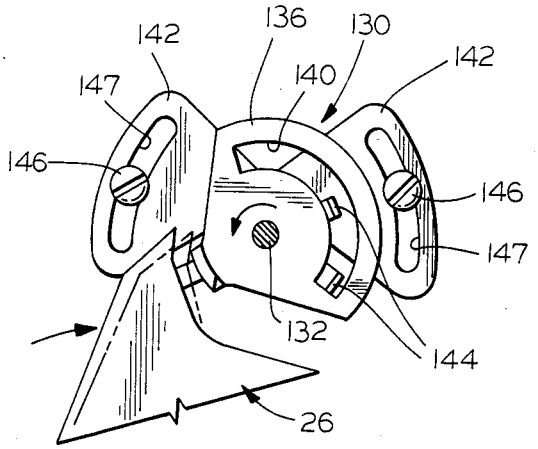
FIG. 12 is a similar fragmentary view of the portion of the elements of the assembly of FIG. 11 shown in their locked position.
Figure 13:
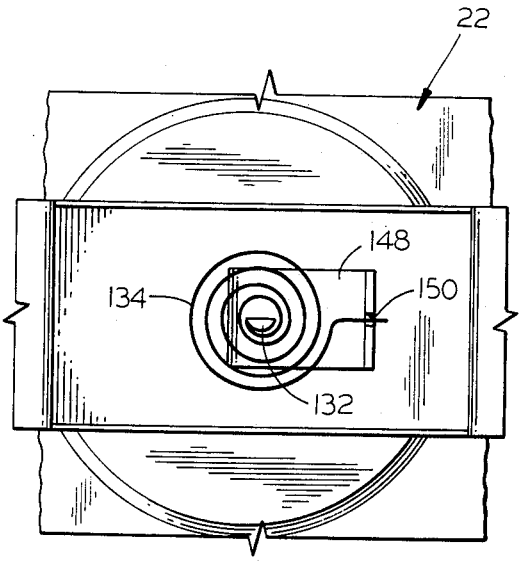
FIG. 13 is a fragmentary bottom view of the bimetallic coil portion of the assembly of the FIGS. 11 and 12.
Figure 14:
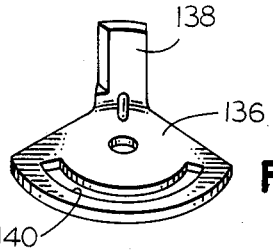
FIG. 14 is a perspective view of the blocking member of the embodiment of FIGS. 11–13.

To unlock the latch assembly 10 and open the oven door 12, the solenoid 96 is reactivated by pressing the clean control switch 97 allowing the latch member 26 to be moved from the position shown in phantom line in FIG. 8 to the position shown in solid line therein as the oven door 12 is opened. However, when the oven temperature is above 600° F., a thermostat switch (not shown) mounted within the oven chamber deactivates the oven cleaning control switch 97 to prevent operation of the solenoid 96 to maintain the door 12 of the oven in the locked condition during the period the oven is in high temperature operation (600°-900°F.).

As will be explained hereinafter, the oven latch assembly 10 cannot be accidentally tripped or latched when the door 12 is in the open position as might occur if the user were to accidentally bump into either the extended latch bolt 18 or the door sensor bar 28, although such could occur if both were simultaneously pushed inwardly. As seen in FIGS. 5 and 6, the door sensor bar 28 cooperates with the bolt 24 of the oven latch assembly 10 to allow generally rectilinear movement of the bolt 24 only if the oven door 12 is properly positioned with respect to the latch assembly 10. Should the user manipulate the door sensor bar 28 when the oven latch assembly 10 is in its open or unlatched position (FIG. 4), the actuator arm 30 pivots around the pivot pin 40 and causes the cam pin 68 and door sensor bar 28 to move along the cam slot 70 from the position shown in solid line to the position shown in phantom line. When the door sensor bar 28 is released, the door sensor tension spring 76 will return the door sensor bar 28 to the position shown in solid line.

Alternatively, should the user manipulate the bolt 24 while the oven door 12 is in the open position, the latch bolt 24 pivots around the cam pin 54 and moves from the position shown in solid line in FIG. 5 to the position shown in FIG. 6. However, the actuator arm 30 moves the cam follower pin 68 in the cam slot 70 of the base plate 22 from the position shown in solid line in FIG. 5 to the captured position shown in FIG. 6 to prevent further movement of the bolt 24 in a rectilinear direction. Thus, it can be seen that the door sensor and bolt interlocking action is a relatively foolproof means for preventing accidental tripping of the latch 10 when the door 12 is open. The door sensor bar 28 in cooperation with the actuator arm 30 permits closure of the latch assembly 10 only when the door 12 is in the proper position relative to the latch assembly 10 as demonstrated in FIGS. 1 and 3-4.

Turning now to FIGS. 11-14, therein illustrated is another embodiment of a locking means for the latch bolt to prevent opening of the oven door during the high temperature cleaning cycle. In this embodiment, the latch member 26 is locked in the latched position by a bimetallic operating mechanism generally designated by the numeral 130.

Mounted at one end of the shaft 132 is a bimetallic coil 134 which has its outer free end disposed in a slot 150 in the mounting plate 148. Mounted at the other end of the shaft 132 is a blocking member 136 with an upstanding lock arm 138, and a spring clutch 139 provides a drive connection between the shaft 132 and the blocking member 136 upon rotation of the shaft 132 by the bimetallic coil 134. The blocking member 136 also has an arcuate slot 140 therein in which are disposed the upstanding lugs 144 on the adjusting plates 142 which are pivotable about the shaft 132 over a limited range of adjustment by loosening the adjusting screws 146 which are slidable within the arcuate slots 147.

The general features of construction of the bimetallic operating mechanism 130 utilizing a bimetallic coil are generally described in U.S. Pat. No. 3,438,666.

In operation, the user closes the door 12 thereby placing the latch assembly 10 in the latched position and starts the oven cleaning cycle by pressing an oven cleaning switch (not shown). The bimetallic coil 134 disposed within the oven chamber is subject to elevated temperatures which cause the coil 134 to unwind as the pair of dissimilar resilient metal strips expands. As the temperature of the oven chamber increases to cleaning temperature, usually above 600° F., the coil 134 rotates the shaft 132 and the blocking member 136 thereon from the unlocked position (FIG. 11) to the locked position (FIG. 12) to block or lock the latch member 26 and thus the oven door 12 in their latched positions until the temperature has decreased below a safe level.

Thus, it can be seen from the foregoing specification and attached drawings that the oven door latch mechanism of the present invention provides an effective and fool-proof combination for latching the door of a self-cleaning oven. To protect the user, the latch mechanism is automatically locked in the closed or latched position during high operation of the oven, but accidental latching or tripping of the latch mechanism is prevented by the door sensor element.

Having thus described the invention, we claim:

1. An automatic safety latch for use in combination with an oven door in a self-cleaning kitchen range having a striker on the door to be engaged therewith, said latch comprising:

a. a base plate;

b. a latch bolt projecting beyond said base plate and having a slot extending inwardly from one side margin of said projecting portion adapted to receive and engage the associated striker;

c. means mounting said latch bolt on said base plate for initial rotational movement from an unlatched position to an intermediate position in which the associated striker is aligned in said slot and for subsequent generally rectilinear movement to a latched position to fully seat the associated striker within said slot;

d. biasing means biasing said latch bolt into each of said unlatched, intermediate and latched positions and permitting said rotational and rectilinear movement of said latch bolt, said biasing means including a latch member, means pivotably mounting said latch member to said latch bolt and for movement between a first position and a second position in which said bolt is latched, and spring means biasing said latch member and thereby said latch bolt into each of said unlatched, intermediate and latched positions thereof;

e. door sensing means operable upon closing of the associated door to permit movement of the latch bolt into the latched position;

f. locking means movable on said base plate from a first position to a second position operatively engageable with said biasing means in the latched position of said latch bolt to prevent movement of said biasing means and thereby said latch bolt from the latched position to the unlatched position, said locking means being movable from a first position to a second position and being engageable with said latch member to prevent its movement from its second position to its first position and thereby to lock the latch bolt in its latched position; and g. actuating means for moving said locking means to said second position and operable upon movement of the associated oven door to the fully closed position.

2. The latch in accordance with claim 1 wherein said actuating means includes heat-responsive means operable upon reaching a predetermined temperature to move said locking means from said first position to said second position and thereafter upon dropping below a predetermined temperature to move said locking means from said second position to said first position and thereby to enable movement of the latch bolt to said unlatched position.

3. The latch in accordance with claim 2 wherein said locking means is mounted upon one end of a rotatable shaft and said heat-responsive means includes a bimetallic coil connected to said shaft to effect its rotation in response to temperature changes.

4. The latch in accordance with claim 1 wherein said actuating means includes manually operable switch means to energize said actuating means and effect movement of said locking means from said first position to said second position.

5. The latch in accordance with claim 4 wherein said actuating means includes solenoid means operatively engageable with said locking means upon energization by said switch means to permit its movement from said first position to said second position.

6. The latch in accordance with claim 1 wherein said biasing means includes a latch member and a pivot pin pivotably mounting said latch member on said base plate for movement between a first position and a second position.

7. The latch in accordance with claim 6 wherein said mounting means for said latch bolt includes a generally V-shaped slot in one of said latch bolt and said base plate adjacent said projecting portion and a cam follower pin in the other thereof slidably seated in said V-shaped slot, a pivot mounting between said bolt and said latch member adjacent the side margin of said bolt on which said striker receiving slot opens and adjacent the end of said bolt spaced from said projecting portion, and an arcuate cam slot in said latch bolt adjacent the end opposite said projecting portion and spaced from said pivot mounting, and wherein said pivot pin for said latch member also comprises a cam follower pin slidably seated in said arcuate cam slot.

8. The latch in accordance with claim 7 wherein said biasing means includes spring means biasing said latch member about its pivotal mounting on said base plate and thereby said latch bolt into each of said unlatched, intermediate and latched positions.

9. The latch in accordance with claim 1 wherein said door sensor means includes a sensor member movably supported on said base plate for movement between a first position and a second position upon closing of the associated door and operatively engaged with said latch bolt to prevent its movement to the latched position until said sensor member is moved to said second position.

10. The latch in accordance with claim 9 wherein said sensor member operatively acts upon said latch member upon movement into its second position to permit movement of the members of the latch and thereby said bolt into its latched position.

11. An automatic safety latch for use in combination with an oven door in a self-cleaning kitchen range having a striker on the door to be engaged therewith, said latch comprising:

a. a base plate;

b. a latch bolt projecting beyond said base plate and having a slot extending inwardly from one side margin of said projecting portion adapted to receive and engage the associated striker;

c. means mounting said latch bolt on said base plate for initial rotational movement from an unlatched position to an intermediate position in which the associated striker is aligned in said slot and for subsequent generally rectilinear movement to a latch position to fully seat the associated striker within said slot;

d. biasing means biasing said latch bolt into each of said unlatched, intermediate and latched positions and permitting said rotational and rectilinear movement of said latch bolt, said biasing means includes:

i. a latch member;

ii. first pivot means pivotably mounting said latch member to said base plate for movement from a first position to a second position;

iii. second pivot means pivotably connecting said latch member and said latch bolt at a point spaced from said first pivot means; and iv. spring means biasing said latch member and thereby said latch bolt into each of said unlatched, intermediate and latched positions thereof;

e. door sensing means operable upon closing of the associated door to permit movement of the latch bolt into the latched position; said door sensing means includes:

i. an elongated sensor member movably supported on said base plate for generally rectilinear movement between a first position and a second position upon closing of the associated door; and ii. an actuator member pivotally connected at one end to said sensor member and at its other end to said latch bolt, whereby generally rectilinear movement of said sensor member will permit subsequent generally rectilinear movement of said latch bolt.

f. locking means on said base plate from a first position to a second position operatively engageable with said biasing means in the latched position of said latch bolt to prevent movement of said biasing means and thereby said latch bolt from the latched position to the unlatched position; and g. actuating means for moving said locking means to said second position and operable upon movement of the associated oven door to the fully closed position.

12. The latch in accordance with claim 11 wherein said base plate includes a cam slot underlying the pivotal connection between said sensor member and said actuator member and wherein the pivotal connection between said sensor and actuator members comprises a cam follower pin slidably seated in said cam slot of said base plate.

13. An automatic safety latch for use in combination with an oven door in a self-cleaning kitchen range having a striker on the door to be engaged therewith, said latch comprising:

a. a base plate;

b. a latch bolt projecting beyond said base plate and having a slot extending inwardly from one side margin of said projecting portion adapted to receive and engage the associated striker;

c. biasing means operably engageable with said latch bolt, said biasing means includes:

i. a latch member;

ii. first pivot means pivotably mounting said latch member to said base plate for movement from a first position to a second position;

iii. second pivot means pivotably connecting said latch member and said latch bolt at a point spaced from said first pivot means; and iv. spring means biasing said latch member in its first position and second positions.

d. means mounting said latch bolt on said base plate for initial rotational movement from an unlatched position to an intermediate position in which the associated striker is aligned in said slot and for subsequent generally rectilinear movement to a latched position to fully seat the associated striker within said slot, mounting means for said latch bolt includes:

i. a generally V-shaped slot in one of said latch bolt and said base plate adjacent said projecting portion and a cam follower pin in the other thereof slidably seated in said V-shaped slot;

ii. a pivot mounting between said bolt and said latch member adjacent the side margin of said bolt on which said striker receiving slot opens and adjacent the end of said bolt spaced from said projecting portion;

iii. an arcuate cam slot in said latch bolt adjacent the end opposite said projecting portion and spaced from said pivot mounting; and iv. a cam follower pin formed as an extension of said first pivot means and slidably seated in said arcuate cam slot.

e. door sensing means operable upon closing of the associated door to permit movement of the latch bolt into the latched position;

f. locking means movable on said base plate from a first position to a second position operatively engageable with said biasing means in the latched position of said latch bolt to prevent movement of said biasing means and thereby said latch bolt from the latched position to the unlatched position; and g. actuating means for moving said locking means to said second position and operable upon movement of the associated oven door to the fully closed position.

14. An automatic safety latch for use in combination with an oven door in a self-cleaning kitchen range having a striker on the door to be engaged therewith, said latch comprising:

a. base plate;

b. a latch bolt projecting beyond said base plate and having a slot extending inwardly from one side margin of said projecting portion adapted to receive and engage the associated striker;

c. means mounting said latch bolt on said base plate for movement from an unlatched position to a latched position to fully seat the associated striker within said slot;

d. biasing means biasing said latch bolt into each of said unlatched and latched positions and permitting said movement of said latch bolt;

e. door sensing means operable upon closing of the associated door to permit movement of the latch bolt into the latched position, said door sensor means including a sensor member movably supported on said base plate for movement between a first position and a second position upon closing of the associated door and operatively engaged with said latch bolt to prevent its movement to the latched position until said sensor member is moved to said second position, said sensor member being elongated and mounted for generally rectilinear movement relative to said base plate, said sensor means also including an actuator member pivotally connected at one end to said sensor member and at its other end to said bolt member whereby generally rectilinear movement of said sensor member will permit subsequent generally rectilinear movement of said latch bolt; and f. locking means engageable with said biasing means in the latched position of said latch bolt to prevent movement of said biasing means and thereby said latch bolt from the latched position to the unlatched position.

15. The latch in accordance with claim 14 wherein said biasing means includes:

a. latch member;

b. first pivot means pivotably mounting said latch member to said base plate for movement from a first position to a second position;

c. second pivot means pivotably connecting said latch member and said latch bolt at a point spaced from said first pivots means;

d. spring means biasing said latch member and thereby said latch bolt into each of said unlatched, intermediate and latched positions thereof, said pivotal mountings between said actuator member and latch bolt and between said latch bolt and said latch member being substantially coaxial.

16. The latch in accordance with claim 15 wherein said base plate includes a cam slot underlying the pivotal connection between said sensor member and said actuator member and wherein the pivotal connection between said sensor and actuator members comprises a cam follower pin slidably seated in said cam slot of said base plate.

17. The latch in accordance with claim 14 wherein said sensor member operatively acts upon said latch member upon movement into its second position to permit movement of the members of the latch and thereby said bolt into its latched position.

18. An automatic safety latch for use in combination with an oven door in a self-cleaning kitchen range having a striker on the door to be engaged therewith, said latch comprising:

a. a base plate;

b. a latch bolt projecting beyond said base plate and having a slot extending inwardly from one side margin of said projecting portion adapted to receive and engage the associated striker;

c. means mounting said latch bolt on said base plate for initial rotational movement from an unlatched position to an intermediate portion in which the associated striker is aligned in said slot and for subsequent generally rectilinear movement to a latched position to fully seat the associated striker within said slot;

d. biasing means biasing said latch bolt into each of said unlatched, intermediate and latched positions and permitting said rotational and rectilinear movement of said latch bolt, said biasing means including a latch member, first pivot means pivotably mounting said latch member to said base plate for movement from a first position to a second position, second pivot means pivotably connecting said latch member and said latch bolt at a point spaced from said first pivot means, and spring means biasing said latch member and thereby said latch bolt into each of said unlatched, intermediate and latched positions thereof.

e. door sensing means operable upon closing of the associated door to permit movement of the latch bolt into the latched position;

f. locking means movable on said base plate from a first position to a second position operatively engageable with said biasing means in the latched position of said latch bolt to prevent movement of said biasing means and thereby said latch bolt from the latched position to the unlatched position; and g. actuating means for moving said locking means to said second position and operable upon movement of the associated oven door to the fully closed position.

19. The latch in accordance with claim 18 wherein said mounting means includes cam means operative between said latch member and said latch bolt, said cam means and said first pivot means include a common pivot pin fixed in one of said latch bolt and latch member and a cam slot in the other of said members.

20. The latch in accordance with claim 18 wherein said locking means is operatively engageable with said latch member to prevent its movement from its second position to said first position and thereby to lock said latch bolt in its latched position.

21. An automatic safety latch for use in combination with an oven door in a self-cleaning kitchen range having a striker on the door to be engaged therewith, said latch comprising:

a. a base plate;

b. a latch bolt projecting beyond said base plate and having a slot extending inwardly from one side margin of said projecting portion adapted to receive and engage the associated striker;

c. means mounting said latch bolt on said base plate for initial rotational movement from an unlatched position to an intermediate position in which the associated striker is aligned in said slot and for subsequent generally rectilinear movement to a latched position to fully seat the associated striker within said slot;

d. biasing means biasing said latch bolt into each of said unlatched, intermediate and latched positions and permitting said rotational and rectilinear movement of said latch bolt, said biasing means including a latch member and means pivotably mounting said latch member to said latch bolt and for movement between a first position and a second position in which said bolt is latched;

e. door sensing means operable upon closing of the associated door to permit movement of the latch bolt into the latched position;

f. locking means movable on said base plate from a first position to a second position operatively engageable with said biasing means in the latched position of said latch bolt to prevent movement of said biasing means and thereby said latch bolt from the latched position to the unlatched position, said locking means being movable from a first position to a second position and being engageable with said latch member to prevent its movement from its second position to its first position and thereby to lock bolt in its latched position, said locking means including a lever member pivotably mounted at one end to said base plate, spring means normally biasing said lever member into a first position, and a lock member movably supported on said level member and engageable with said biasing means upon movement thereof from a first position to a second position to prevent movement of said biasing means and thereby movement of said latch bolt whereby said solenoid means is operable on said level to overcome said spring means to permit movement of said level member and thereby said lock member; and g. actuating means for moving said locking means to said second position and operable upon movement of the associated oven door to the fully closed position, said actuating means including manually operable switch means to energize said actuating means and effect movement of said locking means from said first position to said second position and solenoid means operatively engageable with said locking means upon energization by said switch means to permit its movement from said first position to said second position.

22. The latch in accordance with claim 21 wherein said locking means is pivotably mounted on said lever at a point spaced from the lever pivot and wherein said locking means additionally includes spring means biasing said lock member to its locking position.

23. An automatic safety latch for use in combination with an oven door in a self-cleaning kitchen range having a striker on the door to be engaged therewith, said latch comprising:

a. a base plate;

b. a latch bolt projecting beyond said base plate and having a slot extending inwardly from one side margin of said projecting portion adapted to receive and engage the associated striker;

c. means mounting said latch bolt on said base plate for initial rotational movement from an unlatched position to an intermediate position in which the associated striker is aligned in said slot and for subsequent generally rectilinear movement to a latched position to fully seat the associated striker within said slot;

d. biasing means biasing said latch bolt into each of said unlatched, intermediate and latched positions and permitting said rotational and rectilinear movement of said latch bolt;

e. door sensing means operable upon closing of the associated door to permit movement of the latch bolt into the latched position, said door sensing means including a sensor member movably supported on said base plate for movement between a first position and a second position upon closing of the associated door and operatively engaged with said latch bolt to prevent its movement to the latched position until said sensor member is moved to said second position, said sensor member being elongated and mounted for generally rectilinear movement relative to said base plate, said sensor means including an actuator member pivotally connected at one end to said sensor member and at its other end to said bolt member whereby generally rectilinear movement of said sensor member will permit subsequent generally rectilinear movement of said latch bolt;

f. locking means movable on said base plate from a first position to a second position operatively engageable with said biasing means in the latched position of said latch bolt to prevent movement of said biasing means and thereby said latch bolt from the latched position to the unlatched position; and g. actuating means for moving said locking means to said second position and operable upon movement of the associated oven door to the fully closed position.

24. The latch in accordance with claim 23 wherein said biasing means includes:

a. latch member;

b. first pivot means pivotably mounting said latch member to said base plate for movement from a first position to a second position;

c. second pivot means pivotably connecting said latch member and said latch bolt at a point spaced from said first pivot means; and d. spring means biasing said latch member and thereby said latch bolt into each of said unlatched, intermediate and latched positions thereof, said pivotal mountings between said actuator member and latch bolt and between said latch bolt and said latch member being substantially coaxial.

25. The latch in accordance with claim 24 wherein said base plate includes a cam slot underlying the pivotal connection between said sensor member and said actuator member and wherein the pivotal connection between said sensor and actuator members comprises a cam follower pin slidably seated in said cam slot of said base plate.

* * * * *